United States Patent [19]

Ito et al.

[11] Patent Number: 4,556,033

[45] Date of Patent: Dec. 3, 1985

[54] AIR/FUEL RATIO FEEDBACK CONTROL FOR AN INTERNAL COMBUSTION ENGINE

[75] Inventors: Toshimitsu Ito; Nobuyuki Kobayashi, both of Toyota, Japan

[73] Assignee: Toyota Jidosha Kabushiki Kaisha, Toyoto, Japan

[21] Appl. No.: 583,267

[22] Filed: Feb. 24, 1984

[30] Foreign Application Priority Data

Mar. 14, 1983 [JP] Japan ..... 58-42843

[51] Int. Cl.[4] ..... F02D 35/00; F02M 51/00; F02B 3/04

[52] U.S. Cl. ..... 123/440; 123/480; 123/486; 364/431.06

[58] Field of Search ..... 123/440, 480, 437, 486; 364/431.06

[56] References Cited

U.S. PATENT DOCUMENTS

| | | | |
|---|---|---|---|
| 4,408,584 | 10/1983 | Yabuhara et al. | 123/440 |
| 4,449,508 | 5/1984 | Glockler et al. | 123/440 |
| 4,458,319 | 7/1984 | Chujo et al. | 364/431.06 |
| 4,459,669 | 7/1984 | Chujo et al. | 364/431.06 |
| 4,462,374 | 7/1984 | Kobayashi et al. | 123/440 |
| 4,463,594 | 8/1984 | Raff et al. | 123/440 |
| 4,475,512 | 10/1984 | Suzuki et al. | 123/440 |
| 4,479,464 | 10/1984 | Konto et al. | 123/440 |

*Primary Examiner*—Raymond A. Nelli

*Attorney, Agent, or Firm*—Cushman, Darby & Cushman

[57] ABSTRACT

A method and apparatus for performing air/fuel ratio feedback control for an internal combustion engine by comparing the results of the two comparisons; (a) comparing a determined (i.e., decision) value with a measured value detected by an oxygen sensor, and (b) comparing the determined value with a reference value, so as to determine if either is relatively large or small. Further included is an arrangement for determining whether the determined value coincides with the measured value as well as whether it coincides with the reference value, and then increasing or decreasing the determined value in accordance with the result of the determination (comparison), thereby correcting an abnormal condition of the determined (i.e., decision) value whenever the determined value is displaced from a normal condition due to injected random noise.

6 Claims, 15 Drawing Figures

AIR/FUEL RATIO FEEDBACK CONTROL FOR AN INTERNAL COMBUSTION ENGINE

BACKGROUND OF THE INVENTION

1. Field of the Invention

The present invention relates to a apparatus for performing air/fuel ratio feedback control for an internal combustion engine, and more particularly to a method for performing air/fuel ratio feedback control for an engine which reduces the effects of noise when using a defined determining (i.e., decision) value, calculated in part, at least, from detected values of oxygen density in exhaust gas, as a criterion for determining air/fuel ratios.

2. Description of the Prior Art

Conventionally, in an internal combustion engine for performing air/fuel ratio feedback control by an output signal from an oxygen sensor, a method is known in which the output signal from an oxygen sensor (placed in the exhaust gas atmosphere) is converted into a digital signal at predetermined time intervals, with a determined (i.e., decision) value established based upon the converted digital value. Examples of such methods include U.S. Pat. to Chujo Nos. 4,459,669 and 4,458,319, which are herein incorporated by reference. This determined value is then compared with the output signal from the oxygen sensor to determine whether the intake mixture of air and fuel is in the so-called "lean burn zone" or in the "rich burn zone". The determined (decision) value is necessary for early detection of the change of air/fuel ratio and for controlling the ratio.

FIG. 1 shows, for instance, a relationship between a measurement or measured value and a determined value as well as the relationship between a flag XAF and an air ratio/fuel feedback signal FAF. In these curves, the solid line G1 indicates the change in the measured value of the output from the oxygen sensor, the dotted line G2 indicates the change in the determined value. In the curves, in the portion before the time T2 and the portion between the time T5 to T8, the measured value is below the determined value, and thus defines a lean burning zone. On the other hand, in the area between time T2 to T5 and after the time T8, the measured value is above the determined value, and thus defines a rich burning zone.

The change in the determined value enables an early detection of the change or transition of the measured value, that is, that the oxygen density or concentration is increasing or decreasing.

FIG. 2 shows an OX decision subroutine flow chart for setting the determined value. In step 1, a determination or decision is made whether or not the flag XAF=1, which is indicated as 1 in a rich burn zone and is indicated as 0 in a lean burn zone.

In step 2, a decision is made whether or not the value which is subtracted from the measured value OX by the determined (i.e., decision) value OXR is above a predetermined positive value a. In step 3, the value which was subtracted from the measured value OX by the predetermined value a is set for the determined value OXR.

In step 4, a decision is made whether or not the value which was subtracted from the measured value OX by the determining value OXR is above a predetermined negative value b. The step 5 is for setting the value which was subtracted from the measured value OX by the predetermined value b with respect to the measured value OXR. In step 6, a decision is made whether or not the measured value OX is above the determined value OXR. The step 7 is for setting the binary number "1" for the flag XAF, while the step 8 is for setting "0" for the flag XAF.

In this OX decision subroutine, each step is executed, for example, every 12 msec and decisions are made whether each particular area belongs to the lean burn zone or rich burn zone by comparing the traces of the measured value G1 and the determined value G2, as shown in FIG. 1.

Namely, first in step 1, if the flag XAF=0, (i.e., in the lean barn zone) the result of the decision becomes NO and the operation moves to step 4. In step 4, a decision is made whether or not the value (OX−OXR) is below the predetermined negative value b, and if the result of the decision is NO, the operation now moves to step 5. In step 5, the value which was subtracted from the measured value OX by the predetermined negative value b is set for the determined (i.e., decision) value OXR and the operation now moves to the step 6. In this step 6, the measured value OX is compared with the determined value OXR and if OX is equal to or less than the OXR, the result of the decision is NO and the operation moves to the next step 8, where the flag XAF is set to 0, i.e. XAF=0.

Afterward, as long as the conditions XAF=0 and OX−OXR≦b are maintained, the above operation is repeated. This condition corresponds to the portion before the time T1 in FIG. 1. In this case, the value OX decreases and the difference between OX and OXR is maintained at the value −b.

Next, when the decrease in the value of OX is stopped by certain feedback control, the result of the decision becomes YES since OX−OXR is above the value b (i.e., OX−OXR>b in step 4) and the operation now moves to the step 6. In the step 6, the result of the decision becomes NO since the relationship OX≦OXR has still been maintained and the operation moves to the step 8, where the binary number "0" is set for the flag XAF, i.e. XAF=0. Afterward, as long as the conditions XAF=0 and OX−OXR>b are maintained, the above operations are repeated.

This condition corresponds to the portion between the time T1 and T2 in the curve in FIG. 1. In this case, the value OX is turned from zero to a positive value in gradient, while the value OXR is maintained constant in parallel with the time axis of the graph.

The value OX continues increasing afterward, and when it becomes above the value OXR, the result of the decision in the step 6 becomes YES since the relationship is OX>OXR in the step 6 and the operation now moves to the step 7, where the flag XAF is set to "1". This condition corresponds to the portion just after the cross point at the time T2 where the values OX and OXR intersect each other, as shown in FIG. 1. Afterward, it is considered as being the rich burn zone.

After the time T2, the result of the decision becomes YES since the flag XAF is "1", i.e. XAF=1 in step 1 and the operation now moves to the step 2. In this step 2, a decision is made as to whether or not the value OX−OXR is larger than the predetermined positive value a. If so, the result of the decision is NO since OX−OXR has been larger than 0 (and it is not beyond the predetermined positive value a) and the operation moves to the step 6.

In the step 6, since the value OX is larger than the value OXR, i.e. OX>OXR, the result of the decision becomes YES and now the operation moves to the next step 7. In this step 7, the flag XAF is set to "1", during which there is no change in the value of OXR. This condition is indicated in the time period between the time T2 and the time T3.

Moreover, when the increase in the value OX continues and the difference between the value OX and the value OXR is beyond the predetermined positive value a, the result of the decision becomes YES in the step 2 since OX−OXR>a, and the operation now moves to the next step 3, where the value which was subtracted from the value OX by the value a is set for the value OXR. In the step 6, the result of the decision becomes YES and the operation now moves to the next step 7, where the number "1" is set into the flag XAF, i.e. XAF=1. Afterward, if the conditions XAF=1 and OX−OXR>a are maintained, the above operations are repeated. This condition corresponds to the area between the time T3 and T4. During this time period, the difference between the values OX and OXR is maintained at the value a.

Next, when the increase in the value OX is stopped, the result of the decision in the step 2 becomes NO as the relationship OX−OXR≦a is established and the operation now moves to the step 6. In the step 6, since the value OX is still larger than the value OXR, the result of the decision is YES and the next step 7 is executed, where the flag XAF is set to "1", i.e. XAF=1 is established. Afterward, the above operations are repeated as long as the conditions XAF=1 and OX−OXR≦a are maintained. This condition corresponds to the condition between the time T4 and the time T5 in FIG. 1. In this case, the value OX turns from zero to negative gradient value, while the value OXR is maintained constant in parallel with the time axis.

Next, the decrease in the value OX continues and when it becomes below the value OXR, the result of the decision becomes NO since the relationship is OX≦OXR in the step 6) and the operation now moves to the next step 8, where the flag XAF is set to "0". This condition corresponds to the cross point at the time T5 where the values OX and OXR intersect each other in FIG. 1. Afterward, it is considered as being the lean burn zone.

After the time T5, the result of the decision becomes NO since the flag XAF is zero, i.e. XAF=0 in the step 1, and the operation now moves to the step 4. In this step 4, a decision is made as to whether or not the value OX−OXR is larger than the predetermined negative value b. In this case, the result of the decision is YES since OX−OXR has been equal to or less than 0 and it is beyond the predetermined negative value b, and the operation moves to the step 6.

In the step 6, since the value OX is equal to or less than the value OXR, i.e. OX≦OXR, the result of the decision becomes NO and now the operation moves to the next step 8. In this step 8, the flag XAF is set to "0", during which there is no change in the value of OXR. This condition is indicated in the time period between the time T5 and the time T6.

Moreover, when the decrease in the value OX continues and the difference between the value OX and the value OXR is below the predetermned negative value b, the result of the decision becomes NO in the step 4 since OX−OXR≦b is maintained, and the operation now moves to the next step 5, where the value which was subtracted from the value OX by the value b is set for the value OXR. That is, the value OXR is larger than the value OX by the absolute value of b. In the step 6, the result of the decision becomes NO and the operation now moves to the next step 8, where the number "0" is set for the flag XAF, i.e. XAF=0. Afterward, if the conditions XAF=0 and OX−OXR≦b continue, the above operations are repeated. The portion indicated between the time T6 and the time T7 shows this condition.

The operation between the times T6 and T7 is similar to that before T1, during which the difference between the values OX and OXR is maintained at the absolute value of b.

In such a manner as described in the foregoing, each particular zone is decided or determined whether it is in a rich burn zone or a lean burn zone, and the air/fuel ratio is feedback-controlled in the air/fuel feedback control subroutine (not shown) in accordance with the result thereof and in response to an air/fuel feedback signal, for example, by regulating the open time of a fuel injection valve.

The characteristic curve X in FIG. 1 shows the condition of XAF during each time period while the characteristic curve Y shows the condition of the air/fuel ratio feedback signal FAF. As described above, operating conditions are maintained so that, prior to the time T2, XAF=0; between the time T2 and T5, XAF=1; between the time T5 and T8; XAF=0, and after the time T8, XAF=1. In this case, if flag XAF is zero, i.e. XAF=0, the air/fuel ratio feedback signal FAF becomes a rich burn signal, while FAF becomes a lean burn signal if XAF=1.

However, if the determined (or decision) value OXR becomes abnormal for any reason, feedback control is no longer possible thereafter, or it results in the degradation of driveability and proper emission as a result of an erroneous feedback control thereto, according to the prior art.

Conventionally, the determined value is calculated based on the measured values of the oxygen concentration with subsequent determined values determined in accordance with the correlation between the current determined value and the measured value. Accordingly, if the determined value becomes defective erroneous feedback control will not automatically return to normal since subsequent determined values are determined from the correlation between the erroneous determined value and the measured value. Such erroneous feedback control will often continue for further time periods.

For example, supposing that in FIG. 1 during the time period between the time T3 and the time T4, the value OXR is set at the time N1 to the value m (the point P1 in FIG. 1) which is above the value OX because of any additive noise in the system. In the normal condition after time T3, the operation is made in such a manner that steps 1, 2, 3, 6 and 7 of FIG. 2 are to be executed. In this case, if an erroneous setting has caused OXR to be set at M, for example, in the step 3 at N1, the result of the decision in the next step 6 will become NO as the value OX is smaller than the value OXR, i.e. OX<OXR, and the operation will now move to step 8, where "0" is to be set for the flag XAF.

Next, when the step 1 is executed, the result of the decision becomes NO since XAF=0 has been established in the previous operation of the subroutine and the operation will move to the next step 4. However, when the value m is not as large, the result of the decision becomes YES in the step 4, with the relationship OX−OXR>b being established, and the operation will now move to the next step 6, where the result of the decision will become NO. The operation will move to the step 8, where "0" is set into the flag XAF. In this manner as described, the value OXR is maintained at the value m. During that time period, however, notwithstanding the fact that the value OXR is actually in the rich burn zone, it is determined as being in the lean burn zone with XAF=0. And yet, the increase in the value OX can not be stopped although it passes by the point corresponding to the time T4 in FIG. 1 under feedback control and it is determined as being in the lean burn zone until the value OX is beyond the value m. These conditions are shown in FIG. 3. In FIG. 3, it is indicated that OXR moves to the point P1 by changing the value to m because of the noise (previously discussed) at the time T12. That is, the operation after the time T12 will be similar to that after the time T1 in FIG. 1, as shown in the dotted line G3 in FIG. 3, and the total level thereof will be increased.

On the other hand, when the value OXR becomes the value n at the point P2 which is relatively large, due again to the noise, the result of the decision will become NO in the step 6 and the next step 8 is to be executed, where "0" is set for the XAF flag.

Next, when the step 1 is executed, the result of the decision in the step 1 becomes NO since XAF=0 is set in the previous operation of the subroutine and the operation now moves to the next step 4. In this step 4, when the value n is relatively large, the relationship OX−OXR≦b is established, so that the result of the decision in this step becomes NO and the operation moves to the step 5, where the value OX−b is set for the value of OXR. This value is indicated at the point P3 in FIG. 3. Next, the result of the decision in the next step 6 becomes NO and the operation now moves to the step 8, where "0" is set into the flag XAF.

Next, when the operation returns to the step 1, the result of the decision becomes NO and the operation now moves to the next step 4. In this step 4, since the relationship OX−OXR>b is established because of the increase in the value of OX by the feedback control, the result of the decision will become YES and the next step 6 is to be executed, where the result of the decision becomes NO and the operation moves to the step 8, where "0" is set for the XAF flag. In this manner, the value OXR is maintained at the point P3. However, during that time period, although it is actually in the rich burn zone, XAF=0 has been previously established and the result of the decision will be as if it were in the lean burn zone. Afterward, the operation after the time T1 will be as shown in the dotted line G1 in FIG. 1. In this manner as described above, the value of OXR changes due to the introduction of noise into the OXR determined values and, in turn, the level of the air/fuel ratio is also changed. This results in the condition that the proper value of OXR can no longer return,

SUMMARY OF THE INVENTION

It is therefore a main object of the present invention to provide a method (and apparatus for such method) of controlling the air/fuel ratio for an internal combustion engine in which even if the determined value (i.e., decision value) becomes abnormal due to, for example, the introduction of random noise, abnormal values are returned to normal promptly so as to prevent a condition such that normal air/fuel ratio feedback control cannot be carried out, thereby preventing degradation of driveability and proper emission.

It is another object of the present invention to provide a method for performing air/fuel feedback control for internal combustion engines in which the determined (i.e., decision) value is either increased or decreased toward a predetermined reference value in accordance with the result of two determinations between the determined value and the measured value and between the determined value and a predetermined reference value.

It is yet another object of the present invention to provide a method for performing air/fuel feedback control for an internal combustion engine in which when the determined value is equal to or smaller than the reference value, an operation for increasing the determined value is carried out, while when the determining value is equal to or larger than the reference value, the operation for decreasing an determining value is carried out.

It is yet still another object of the present invention to provide a method for performing air/fuel ratio feedback control for an internal combustion engine in which the determining value is compared with the measured value and the reference value so as to determine which is large or small, then a determination is made as to whether the determining value is beyond the measured value as well as determined the reference value, and the operation for changing the determining value is performed in then accordance with the result of the determination so as to cause any abnormal conditions to be returned to normal when the determined value is offset from normal conditions to introduced noise.

It is yet another object of the present invention to provide a method for performing air/fuel ratio feedback control for internal combustion engines in which a flag for indicating whether or not the measured value is in a rich burn zone or a lean burn zone is equal to 1 is determined, and another determination is made whether or not the measured value minus the determined value is above either a predetermined positive value or negative value and the determining value is set to the measured value minus the predetermined positive or negative value (or constant) in accordance with the result of the second determination. And, in addition, another determination is made whether or not the measured value is above the determining value, and the flag is set to the binary number "1" or "0" in accordance with the result of the last determination.

According to the present invention, one of the features thereof resides in that a method for performing air/fuel ratio feedback control for an internal combustion engine including the steps of comparing a measured value of oxygen concentration (or density in exhaust gases) with a determined value and in accordance with the comparison, controlling the air/fuel ratio of intake air/fuel mixture, determining whether or not the air/fuel ratio is in a rich burn zone, setting a new value which was subtracted from the measured value by a predetermined positive value for the determined value when the air/fuel ratio is in the rich burn zone in accordance with the result of the determination and when the measured value minus the determining value is above the predetermined positive value while determining the air/fuel ratio whether or not the measured value is in a lean barn zone, and setting a new second value which is the measured value minus a predetermined negative value for the determining value when the air/fuel ratio is in the lean burn zone in accordance with the result of the determination and when the measured value minus the determining value is below the predetermined negative value, wherein the step of changing the determining value toward a predetermined reference value when a first determination (which is large or small) between the determined value and the measured value coincides with a second determination (which is large or small) between the determined value and the predetermined reference value while maintaining the determined value constant when these two determinations fail to coincide with each other.

These and other objects and advantages of the present invention will be apparent and be better understood in the following description with reference to the accompanying drawings.

DETAILED DESCRIPTION OF PREFERRED EMBODIMENT

Figure 4:
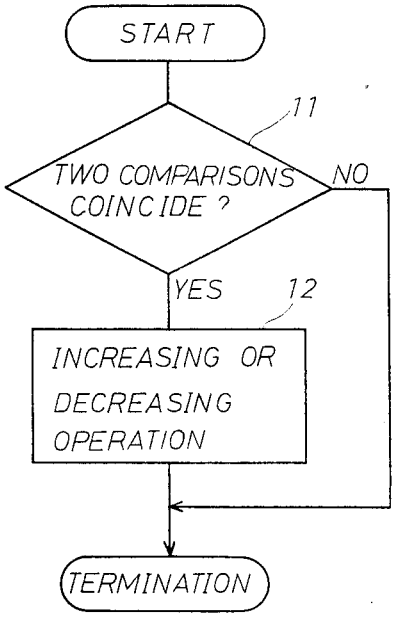
FIG. 4 illustrates a basic flow chart of the method according to the present invention.

Referring to FIG. 4, where a basic flow chart of a subroutine for realizing the method according to the present invention is shown, reference numeral 11 indicates a step for deciding whether or not a first determination or comparison (which indicates large or small between the determined value and the measured value) coincides with a second determination or comparison (which indicates large or small between the determine value and a reference value). The step 12 is for increasing or decreasing the determined values, that is, if the determining value is equal to or smaller than the reference value, an operation for increasing the determined value is carried out, while if the determined value is equal to or larger than the reference value, an operation for decreasing the determined value is carried out.

In step 11 of this routine, if the results of the two comparisons of the determined values with the measured values and with the reference value, respectively coincide, the result of the determination becomes YES and the operation now moves to step 12, where an increasing or decreasing operation is carried out for the determined values and the operations of this particular routine subsequently terminates.

On the other hand, if the results of the two comparisons of the determined value with the measured value and with the reference value, respectively, do not coincide (for example when the determined value is larger than the measured value but smaller than the reference value or when the determined value is smaller than the measured value, but larger than the reference value), the result of the decision in the step 12 becomes NO and the operations of this routine are terminated.

Figure 2:
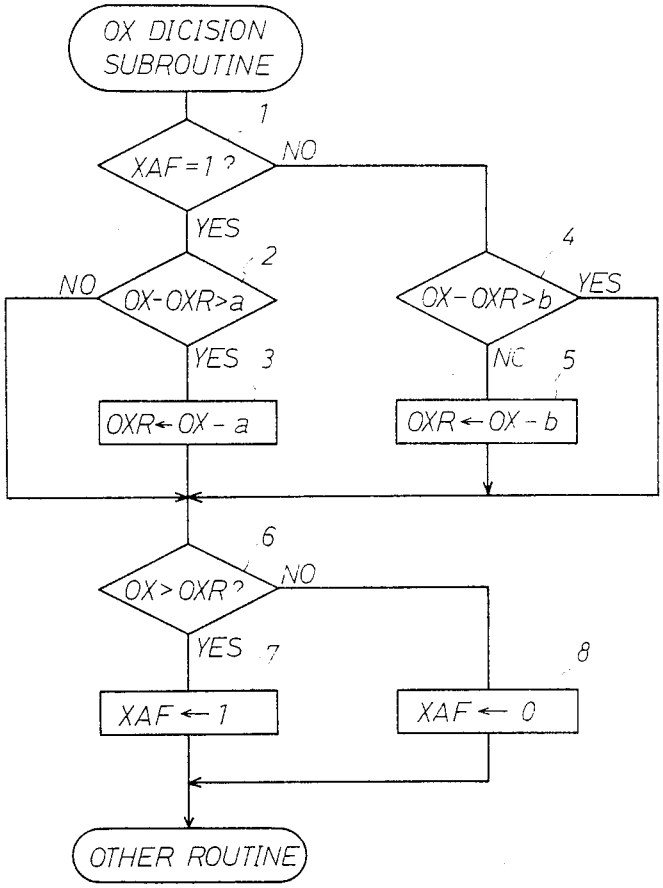
Fig. 2 (Prior Art)
FIG. 2 illustrates an operational flow chart according to the prior art.

The operations of the routine are executed by performing, for instance, a time interupt for the repeated operations of the OX decision subroutine, as shown in FIG. 2. When performing the executions of the subroutine, if the determined value becomes abnormal due to, for example, introduced noise, an operation for correcting the abnormal value to a normal value is carried out.

Figure 5:
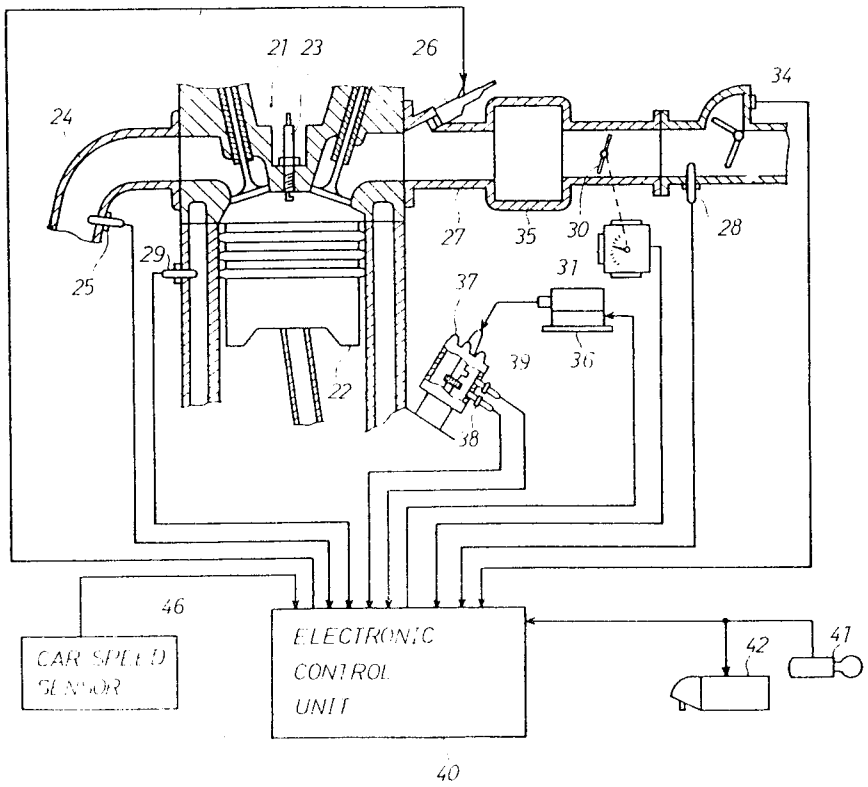
FIG. 5 illustrates an internal combustion engine system including peripheral elements and units to which the method according to the present invention is applied.

FIG. 5 shows an internal combustion engine system and its peripheral units and elements with which the method according to the present invention is applicable.

The overall engine system shown in FIG. 5 comprises an internal combustion engine 21, a piston 22, an ignition plug 23, an exhaust manifold 24, an oxygen sensor 25 mounted in the exhaust manifold 24 for detecting the remaining oxygen concentration (or density) in the exhaust gas, a fuel injection valve 26 for injecting fuel into the intake air in the engine 21, an intake manifold 27, an intake air temperature sensor 28 for detecting the temperature of the intake air to be sent to the engine 21, a water temperature sensor 29 for detecting the temperature of the cooling water for the engine, a throttle valve 30, a throttle opening sensor 31 interlocked with the throttle valve 30 for detecting the opening of the throttle valve 30 and for producing a signal representative thereof, an air flow meter 34 for measuring the intake air flow and a surge tank 35 for absorbing and reducing pulsation of the intake air.

The overall engine system further comprises an ignitor 36 for producing high voltage necessary for ignition, a distributor 37 which is interlocked with a crank shaft (not shown) for supplying the high voltage produced in the ignitor 36 to each ignition plug 23 of each air cylinder, a rotational angle sensor 38 mounted in the distributor 37 for producing twenty-four pulse signals for every one revolution of the distributor 37 or every two revolutions of the crank shaft, a cylinder identifying sensor 39 for producing one pulse signal for every one revolution of the distributor 37, an electronic control unit 40, a key switch 41, a starter motor 42, and a car speed sensor 46 (which is interlocked with the car shaft) for producing pulse signals proportional to the car speed.

Figure 6:
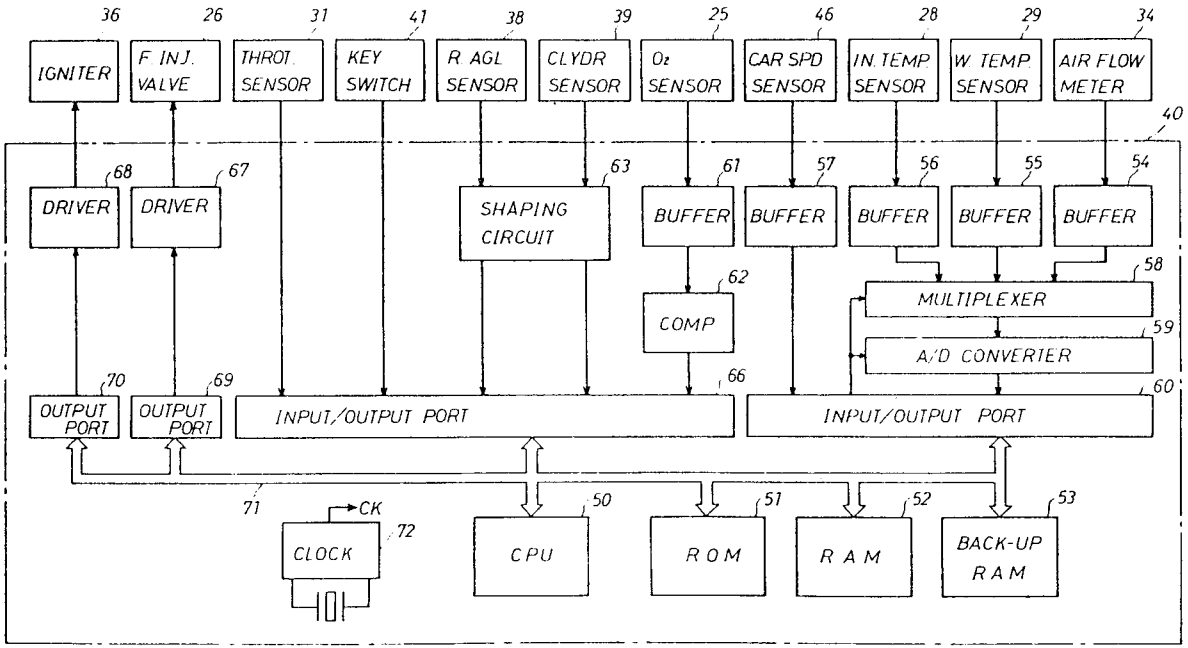
FIG. 6 illustrates a detailed block diagram of the electronic control unit of FIG. 5 and the associated sensors and elements thereof.

FIG. 6 shows the detailed construction of the control unit 40 and its associated elements of FIG. 5. The control unit 40 comprises a central processing unit (CPU) 50 which receives and signal processes various data corresponding to electrical signals produced from each sensor (and each constructing element mentioned in the foregoing) in accordance with control operational sequences in accordance with the present invention. Control unit 40 performs various operations and controls for each unit and constructing element, i.e., a read only memory (ROM) 51 in which control programs and initial data have been stored, a random access memory (RAM) 52 for writing reading data to be processed in the microprocessor or CPU 50, a back-up random access memory (back-up RAM) 53 as a non-volatile memory backed up by a battery so as to retain or hold data necessary for the operation of the engine even if the key switch 41 is turned OFF, buffers 54 through 57 to which each output of the air flow meter 34, the water temperature sensor 29, the intake air temperature sensor 28 and the car speed sensor 46 is connected, multiplexer 58 which selectively produces an output signal from each sensor to the CPU 50, an analog to digital converter (A/D converter) 59 which converts analog signals into digital signals, and an input/output port 60 which sends signals from each sensor to the CPU 50 through the buffers 54 to 57 and/or the multiplexer 58 and the A/D converter 59 while sending control signals from the CPU 50 to the multiplexer 58 and the A/D converter 59.

The control unit 40 also comprises a buffer 61, a comparator 62 to which the output signal from the oxygen sensor 25 is applied, a shaping circuit 63 which shapes the output signals from the rotational angle sensor 38 and the cylinder identifying sensor 39, driving circuits 67 and 68, output port 69, a system clock circuit 72, output ports 69 and 70. The outputs of the key switch 41 and the throttle opening sensor 31 are directly connected to the input of the input/output port 66, and the outputs of the driving circuits 67 and 68 are connected to the fuel injection valve 26 and the ignitor 36. The transfer of data among the CPU 50, ROM 51, RAM 52, the back-up RAM 53, the input/output ports 60 and 66, and the output ports 69 and 70 are carried out through the bus 71.

Figure 1:
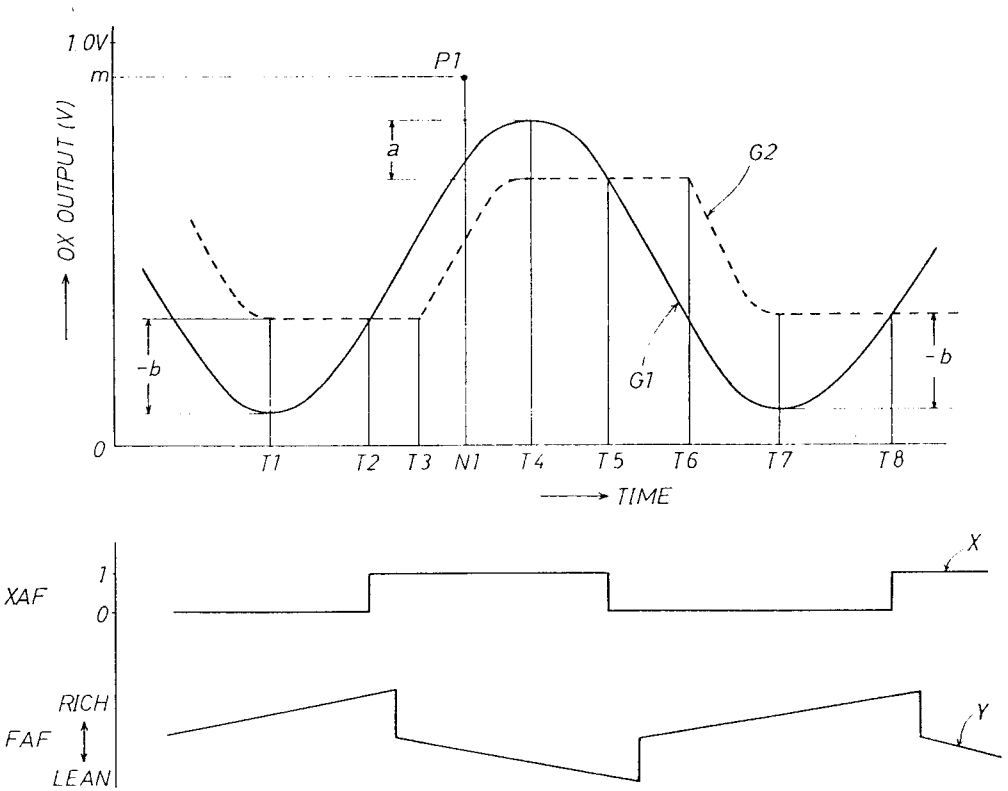
Fig.1 (Prior Art)
FIG. 1 illustrates graphs for explaining the relationship between the measured value and the determined (i.e., decision) value as well as the relationship between the flag XAF and the air/fuel ratio feedback signal FAF according to the prior art.
Figure 7:
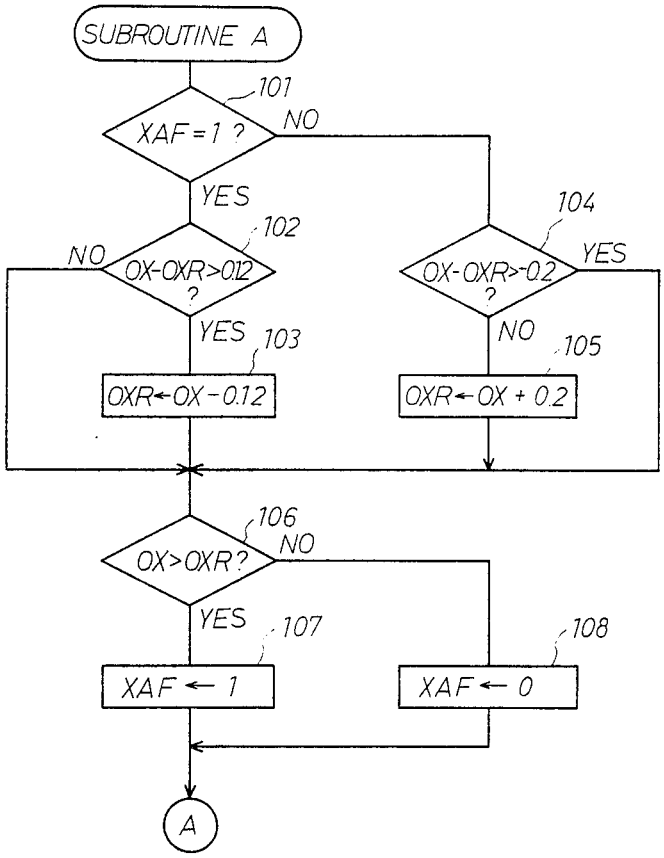
FIGS. 7 and 8 illustrate subroutine flow charts of a first exemplary embodiment of the present invention.

The operation of the control unit 40 will be described with reference to the control flow chart of one embodiment according to the present invention, as shown in FIG. 7. The subroutine A shown in FIG. 7 has a similar construction to the OX decision subroutine and the steps 101 through 108 correspond to those of 1 through 8 in FIG. 2, except that the predetermined positive value a in the steps 2 and 3 in FIG. 2 is set here as a value which corresponds to 0.12 V, while the predetermined negative value b in steps 4 and 5 in FIG. 2 is set here as a value corresponding to −0.2 V. Therefore, mere execution of the subroutine A enables the characteristics shown in FIG. 1 to be controlled.

Figure 8:
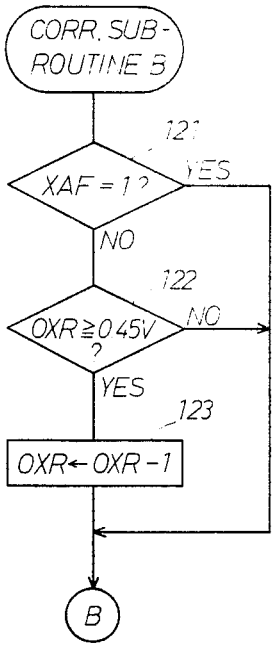

FIG. 8 shows a correction subroutine B. In this subroutine, in step 121, a decision is made whether or not the flag XAF (which indicates either the rich burn zone or lean burn zone) is 1, i.e. XAF=1.

The step 122 is for determining whether or not the determined value OXR is above the reference value. In this case, the reference value is set at a value which corresponds to 0.45 V in the terms of the OXR.

The step 123 is for decrementing the determined value OXR. In the subroutine A mentioned above, the predetermined positive value is set at 0.12 V, but it is also possible to set it within the range of 0.08 to 0.3 V, while the predetermined negative value is set at −0.2 V, but it is also possible to set it within the range of −0.1 to −0.3 V. In the subroutine B, the reference value is set at 0.45 V, which will be a reference value in feedback control, and it is also possible to set it within the range of 0.45 to 0.55 V. The subroutines A and B are executed every 12 msec and every 72 msec, respectively, i.e., the ratio of frequency between the two is 1/6. It is also possible for the ratio of frequency of correction subroutine B to set between the ranges ½ and 1/12. When the subroutine A and the correction subroutine B are combined and executed with an air/fuel ratio feedback control routine which is used generally (not shown), the operation thereof will be carried out according to the graph shown in FIG. 9, in which the solid line shows the measured value while the dotted line shows the determined value.

Now, returning to FIG. 7, in the step 101 a decision is made whether or not the flag XAF is 1. If and if the flag is XAF=0, the result of the decision becomes NO and the operation moves to the step 104. In the step 104, if the value (OX−OXR) which was subtracted from the measured value OX by the determined value OXR is equal to or smaller than the predetermined negative value of −0.2, the result of the decision becomes NO and the operation now moves to the step 105, where OXR is set to the value which was subtracted from the measured value OX by the predetermined negative value −0.2, i.e. the added value of 0.2. In the next step 106, the comparison of OX with OXR is made and if OX is equal to or smaller than OXR, the result of the decision becomes NO and the operation now moves to the step 108, where XAF is set to 0. As long as XAF=0 and OX−OXR≦−0.2 are still maintained, the above operation is repeated. This condition is shown in the time between T20 and T21 in FIG. 9. In this case, OX is reduced and the difference between OX and OXR is maintained at the value of 0.2. Although the correction subroutine B is being executed during the time T20 to T21, the result of the decision in the step 122 becomes NO since OXR<−0.45 V is established and there is no effect on the value of OXR. When the decrease in the value OX is stopped by feedback control, the relation OX−OXR<−0.2 will be established and the result of the decision will become YES, and the operation now moves to the step 106. However, in this step 106, the relation OX≦OXR is still maintained so that the result of the decision becomes NO and the operation moves to the step 108, where XAF is set at 0. If the relation XAF=0 and OX−OXR>−0.2 is maintained afterward, the above operations are repeated. The condition between the time T21 to T22 shown in FIG. 9 indicates this condition. Here, the gradient of OX is turned from 0 to a positive value while OXR is maintained constant in parallel with the time axis.

During the time T21 to T22, the relation OXR<0.45 is maintained so that the correction subroutine B does not affect the value of OXR.

Next, the increase of OX continues and when it becomes above the value of OXR, the result of the decision in the step 106 becomes YES since OX>OXR is established and the operation now moves to the step 107, where XAF is set to 1. This condition corresponds to the portion just after the time T22 at which point the OX and OXR crosses in FIG. 9. After this point, the air/fuel ratio is determined as being in the rich burn zone.

After the time T22, the result of the decision in the step 101 becomes YES as XAF is "1", i.e. XAF=1, and the operation now moves to the step 102, where a decision is made as to whether or not OX−OXR is above the predetermined positive value 0.12. In this case, since OX−OXR has just become above 0; thus it will never become above 0.12. Accordingly, the result of the decision becomes NO and the operation now moves to the step 106. In this step 106, since the relation OX>OXR is maintained, the result of the decision in this step becomes YES and the operation moves to the next step 107, where XAF is set to "1". This condition corresponds to the portion between the time T22 to T23 in FIG. 9. During the time T22 to T23, as XAF=1 is maintained, the result of the decision in the step 121 becomes NO and the operation in the correction subroutine B has no effect on the value of OXR so that it is maintained constant.

The increase in OX continues and when the difference between OX and OXR becomes above the predetermined positive value 0.12, the result of the decision in step 102 become YES since the relation OX−OXR>0.12 is maintained, and the operation now moves to the step 103, where OXR is set to the value which was subtracted from OX by 0.12. Then, the result of the decision in the next step 106 becomes YES and the operation now moves to the step 107, where XAF is set to "1". Afterward, if the relations XAF=1 and OX−OXR>0.12 are maintained, the above operations are repeated. This condition corresponds to the portion between the time T23 to T24 in FIG. 9. During that time, the difference between OX and OXR is maintained at 0.12. During the time T23 to T24, although OXR shown by the dotted line becomes at times above 0.45 V, the operation of the correction subroutine has no effect on the value of OXR as XAF=1; that is OX>OXR is maintained.

Next, when the increase in OX stops, OX−OXR≦0.12 is established, the result of the decision in the step 102 becomes NO and the operation now moves to the step 106. In this step 106, since the relation OX>OXR is still maintained, the result of the decision in this step becomes YES and the operation moves to the next step 107, where XAF is set to 1. Afterward, if the relations of XAF=1 and OX−OXR≦0.12 are maintained, the above operations are repeated. This condition corresponds to the portion between the time T24 and T25. Here, the gradient of OX is turned from 0 to a negative value, while OXR is maintained constant in parallel with the time axis. During the time between T24 and T25, the operation of the subroutine B has no effect on the value of OXR as XAF is 1, i.e. XAF=1.

Next, the decrease in OX continues and when it becomes below the value of OXR, the result of the decision in the step 106 becomes NO since the relation OX≦OXR is maintained, and the operation now moves to the next step 108, where XAF is set to 0. This condition corresponds to the portion at the time T25 at which OX and OXR crosses in FIG. 9. After this time point, it is determined as being in the lean burn zone.

After the time T25, the result of the decision in the step 101 becomes NO since XAF is 0, and the operation now moves to the step 104. In the step 104, a decision is made whether or not OX−OXR becomes above the predetermined negative value of −0.2. However, the value of OX−OXR has just became equal to or below 0 (which is naturally above −0.2) so that the result of the decision in this step becomes YES and the operation moves to the next step 106, where the result of the decision becomes NO as the relation OX≦OXR is maintained, and the operation now moves to the step 107, where XAF is set to 0. During the time T25 to T26, since the relations XAF=1, OX>OXR, and OXR≧0.45 V are established, the result of the decision in the step 121 in the correction subroutine B becomes NO and the operation now moves to the step 122, where the result of the decision will become YES. This permits the next step 123 to be executed and, in step 123, OXR is decremented. As a result, OXR gradually decreases during that time. This condition corresponds to the portion between the time T25 to T26 in the graph in FIG. 9.

Moreover, OX continues lowering and when the difference between OX and OXR becomes below the predetermined negative value of −0.2, the result of the decision in the step 104 becomes NO since the relation OX−OXR≦−0.2 is maintained, and the operation now moves to the next step 105. In this step 105, OXR is set to the value which was subtracted from OX by −0.2, i.e., added value of 0.2, and the operation moves to step 106, where the result of the decision becomes NO and the next step 108 is to be executed and XAF is set to 0. Afterward, as long as the relations XAF=0 and OX−OXR≦−0.2 are maintained, the above operations are repeated. This condition corresponds to the portion between the time T26 and the time T28 in the graph in FIG. 9. In this case when OXR is in the period above 0.45 V, that is, the time between T26 and T27, the result of the decision in the step 121 of the correction subroutine B becomes NO, while the result of the decision in the step 122 becomes YES and the operation now moves to the step 123, where the decrement operation is carried out. However, in this decrement operation, it competes with the setting operation of OXR in the step 105 in the subroutine A, and since OXR is always returned to the value of OX+0.2, the operation in step 123 of the correction subroutine B has no effect on OXR.

The operation between times T26 and T28 is similar to that prior to the time T21, and afterward such an operation as mentioned above is repeated. The difference between OX and OXR during this time period is maintained at the value of 0.2.

In the manner as described above, the rich burn zone or the lean burn zone is determined and the air/fuel ratio can be feedback-controlled by, for instance, regulating the valve opening time of the fuel injection valve in the air/fuel ratio feedback control subroutine (not shown) which is used generally, in accordance with the result thereof.

Figure 10:
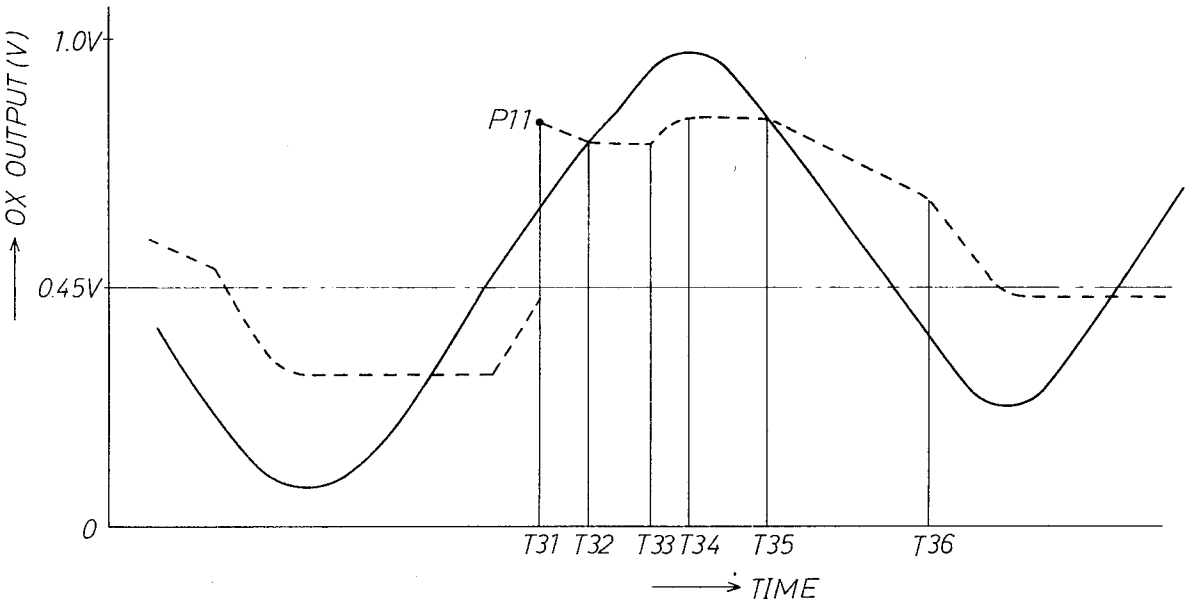

In the above described operations according to the present invention, a condition where OXR becomes above the value of OX due to, for example, noise is shown in FIG. 10. The graph at the time T31 indicate that the value of OXR becomes above the value of OX because of the injected random noise. Just before the time T31, the result of the decision in the step 101 in the subroutine A shown in FIG. 7 becomes YES since XAF=1, and the operation moves to the step 102, where the result of the decision becomes also YES as the relation OX−OXR>0.12, and the operation further moves to the step 103. In this step 103, OX−0.12 is set for OXR, and the operation moves to the step 106, where the result of the decision becomes YES as the relation OX>OXR is established and the operation now moves to the next step 107, where 1 is set for flag XAF and the above operations are repeated.

At the time T31, when for instance the value of OXR jumps to the point P11 due to the noise of the setting time of OXR in the step 103, the result of the decision in the next step 106 becomes NO as the relation OX<OXR is maintained and the operation now moves to the next step 108, where 0 is set for flag XAF.

Then, when the operation is returned to the subroutine A, the result of the decision in the step 101 becomes NO and the operation now moves to the next step 104. In the step 104, if the relation OX−OXR>−0.2 is established, the result of the decision in this step becomes YES and no change occurs in the value of OXR by the operation of the subroutine A.

However, as XAF−0 in the step 121 in the correction subroutine B is established at time T31, the result of the decision in the step 121 becomes NO and the operation now moves to the step 122. In the step 122, the relation OXR≧0.45 V is maintained, the result of the decision becomes YES, and the operation now moves to the next step 123. By the execution of the step 123, the decrement operation of OXR is started. As a result, OXR gradually decreases from the position at the point P11 as shown in the graph in FIG. 10 as the result thereof. The decrease in the value of OXR continues at the time T32 at which OXR and OX crosses each other.

Then, just after the time T32, the result of the decision in the step 106 becomes YES since OX is above OXR, i.e. OX>OXR, and the operation moves to the step 107, where XAF is set to 1. This enables the decrement of OXR in the correction subroutine B to be stopped. On the other hand, in the subroutine A, the result of the decision in the step 101 becomes YES, and the result of the decision in the step 102 becomes NO. As a result, the value of OXR does not change at all in the operations of the both subroutines. In FIG. 10, the graph of OXR becomes parallel with the time axis.

Afterward, at the time T33, the result of the decision in the step 102 of the subroutine A becomes YES since the relation OX−OXR>0.12 is established and the operation now moves to the next step 107, where the value of OX−0.12 is to be set into OXR and the value of OXR changes along the value of OX.

Figure 9:
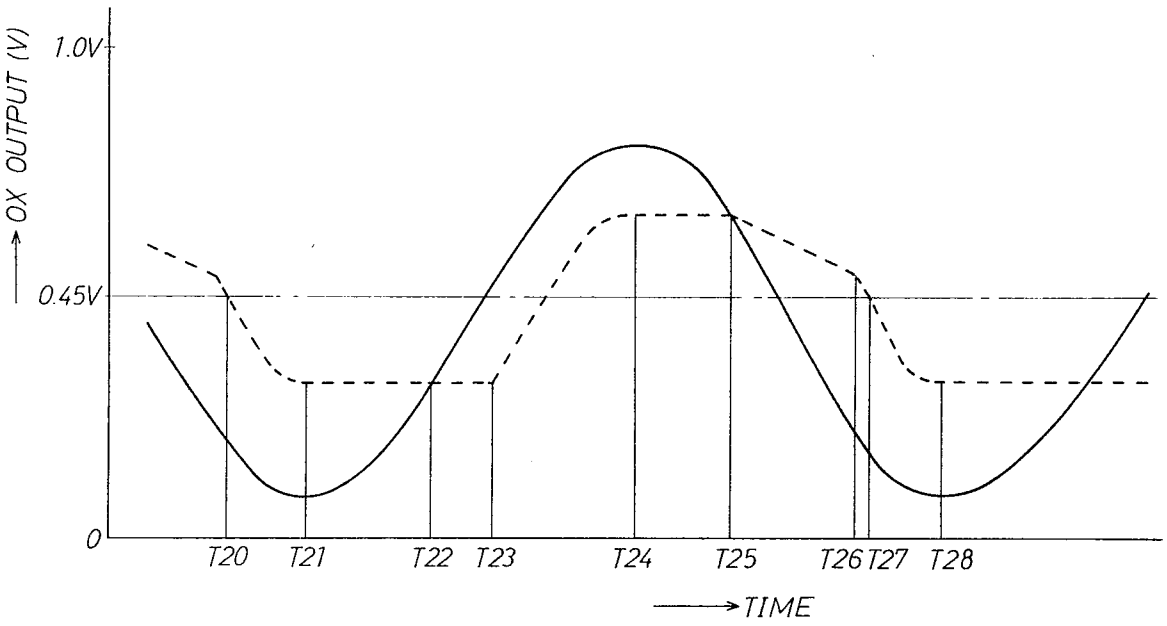
FIGS. 9 through 11 illustrate characteristic curves for explaining the processing or operations of FIGS. 7 and 8.

After that time, OXR changes as shown in FIG. 9 and during the time between time T34 to T35 it becomes parallel with the time axis, while during time T35 to T36 it will reduce by the decrement in the step 123 of the correction subroutine B.

Figure 3:
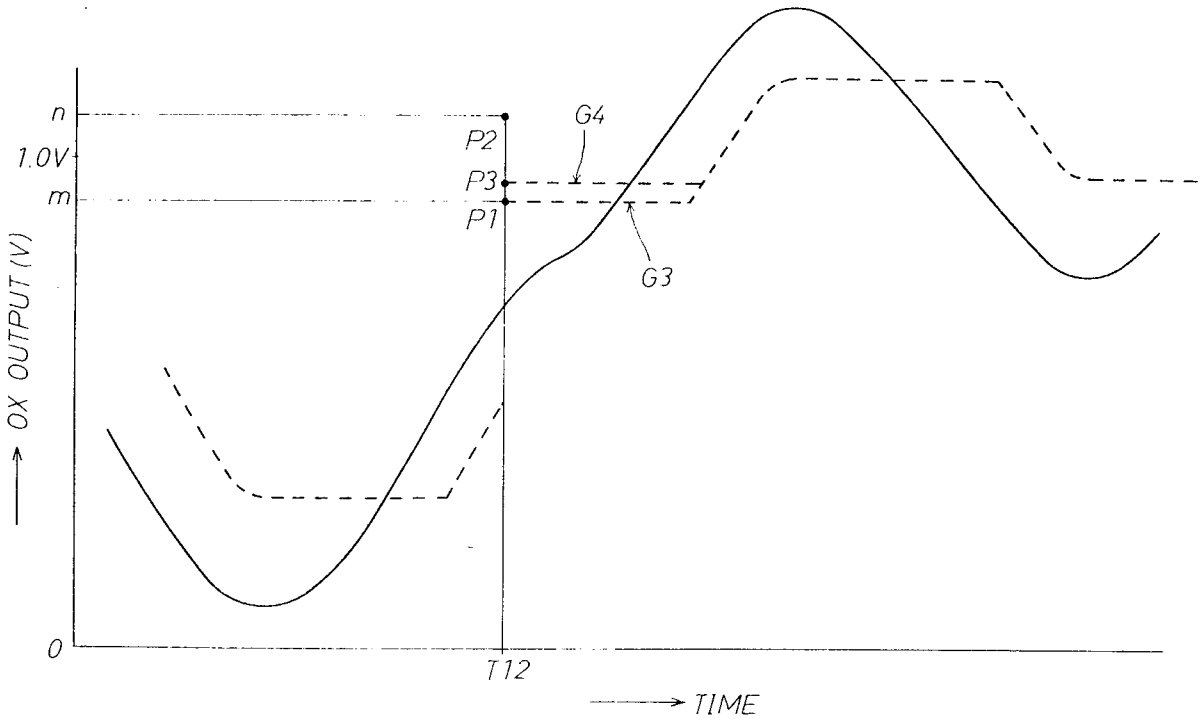
Fig. 3 (Prior Art)
FIG. 3 illustrates a characteristic curve for explaining potential abnormal control due to the prior art methods.

In this manner as described above, after the occurrence of noise, the operation can be returned to an earlier stage, from XAF=0 to XAF=1, by the decreasing operation of OXR in the correction subroutine B so that the increase in the level in the feedback control pattern of OX can be suppressed (i.e., kept small) as compared with the control according to the prior art shown in FIG. 3.

Figure 11:
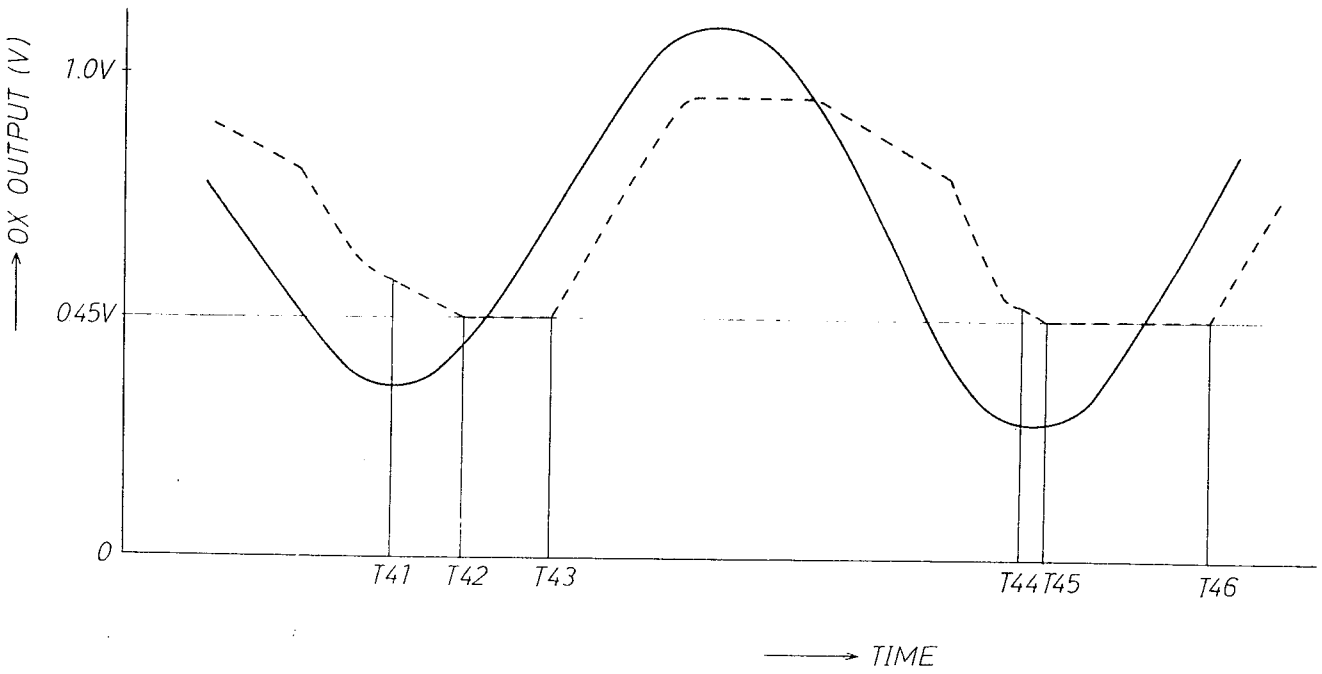

Now, suppose that the level of the above pattern successively increases due to random noise and all of OXR is above the value of 0.45 V, despite the above operations. This situation is shown in the graph in FIG. 11.

In this case, before the time T41, the result of the decision in the step 101 becomes NO and that of the decision in the step 104 becomes also NO in the subroutine A, and the operation now moves to the next step 105. In this step 105, OX+0.2 is set for OXR, and OXR depicts this trace along the movement of OX.

Since at the time T41 in the step 104 of the subroutine A OX−OXR>−0.2, the result of the decision in this step becomes YES. Accordingly, as the step 105 is not executed, the value of OXR is maintained constant in the subroutine A. Moreover, at this time, as the relation OX<OXR is maintained, XAF=0 is established in the next step 108.

On the other hand, in the correction subroutine B in this case, as the relation XAF=0, and OXR≧0.45 V has been established, the decrement of OXR is started in the execution of the step 123. As a result, OXR decreases from the time T41.

Next, as the result of the decrease in OXR, when it becomes below 0.45 V at the time T42, the result of the decision in the step 122 of the correction subroutine B becomes NO. As a result, the decrement in OXR stops. On the other hand, however, the result of the decision in the step 104 in the subroutine A still becomes YES, and since there is no change in the value of OXR, it is maintained constant (i.e., the graph thereof becomes parallel with the time axis).

After the crossing of OXR and OX, the result of the decision in the step 101 in the subroutine A becomes YES since XAF is equal to 1, and the operation now moves to the step 102. In this step 102, since the relationship OX−OXR≦0.12 is still maintained, the result of the decision becomes NO. Accordingly, the value of OXR does not change at all.

Thereafter, at the time T43, the relation OX−OXR>0.12 is established in the step 102 of the subroutine A, the result of the decision in this step become YES and the operation moves to the step 103, where OX−0.12 is set for OXR. As a result, OXR begins changing along OX after the time T43.

After that, unless the minimum of OXR becomes below 0.45 V when no processing or operation of the correction subroutine B is carried out, OXR decreases during the time T44 to T45 while OXR is maintained constant during the time T45 to T46 and similar operations are repeated.

In such a manner as described, when all the patterns of OXR become above 0.45 V, i.e. the minimum of OXR is above 0.45 V when no processing of the correction subroutine B is carried out, an operation for lowering the minimum value less than 0.45 V is performed. This enables XAF to be changed from 0 to 1 in an earlier stage and the movement of OX is corrected toward a normal condition.

In short, in one embodiment according to the present invention, even if OXR jumps due to injected random noise, it is possible for the overall patterns of OX to be prevented from increasing or to be suppressed small. Moreover, even if the overall pattern of OX increases gradually because of the noise, an operation for returning to normal can be effected. By this action, even if noises are produced in the electronic control unit, an abnormal condition of the air/fuel ratio can be held to a minimum, thus preventing the degradation of proper emission and driveability.

In the foregoing first embodiment according to the present invention, only the increase in the OX patterns can be prevented. In general, the direction of noises are almost always such as to increase the value of OXR with some limitations which lower the patterns of OX, which may be acceptable in practical use without taking into consideration the lowering of the OX patterns. However, depending upon some kinds of internal combustion engines, it may be sometimes more effective to prevent the lowering of the patterns for the purpose of preventing the degradations of proper emission and driveability.

Now, a second embodiment according to the present invention which prevents both the increase and decrease of the OX patterns will be described.

Figure 12:
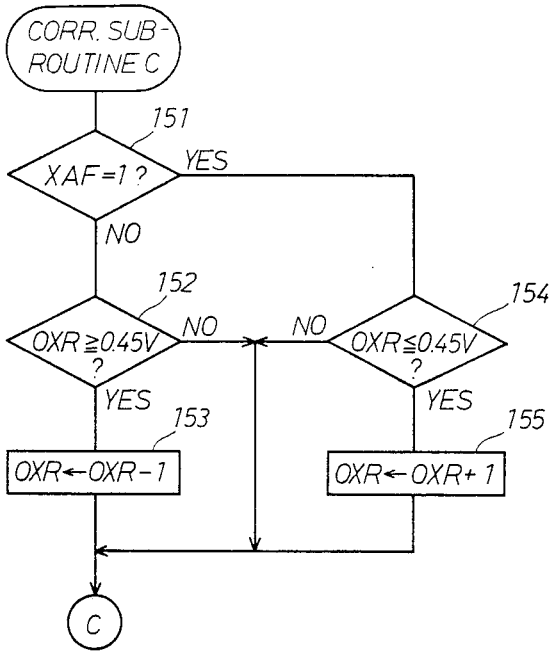
FIG. 12 illustrates part of a flow chart of a second exemplary embodiment according to the present invention.

FIG. 12 shows a correction subroutine C of the second embodiment according to the present invention. Other operations are similar to subroutine A of the first embodiment which has been already described in the foregoing.

In the correction subroutine C, the steps 151 through 153 in FIG. 12 indicate the same operations as those performed in the steps 121 through 123 of the first embodiment. The step 154 indicates a decision step for determining whether or not OXR is below the reference value of 0.45 V.

Figure 13:
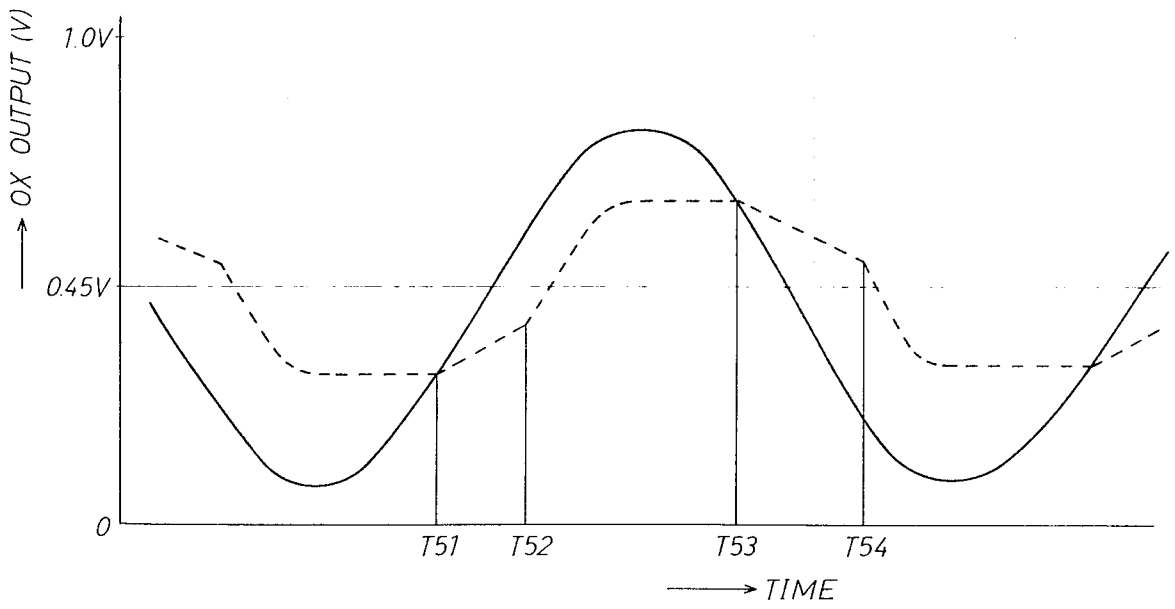
FIGS. 13 through 15 illustrate characteristic curves for explaining the processings or operations of the FIG. 12 embodiment

The step 155 indicates the one for incrementing OXR. In the operation of the correction subroutine C, when XAF=0 is established in the step 151 and the result of the decision in this step 151 becomes NO, the same operation as that of the first embodiment is performed. Namely, when no noise is present on OXR, the value of OXR does not change in the subroutine A during the time T53 to T54, as shown in FIG. 13, and the result of the decision in the step 151 of the correction subroutine C becomes NO as XAF is 0 and the operation moves to the next step 152. In the step 152, as the relation OXR≧0.45 V is established, the result of the decision in this step becomes YES and the operation now moves to the step 153, where the decrement of OXR is executed. This enables OXR to be decreased as in the case of the first embodiment.

On the other hand, when the result of the decision in the step 151 becomes YES as XAF is equal to 1, an operation which is symmetrical around the output of OX of 0.45 V (and which is different from the first embodiment) can be performed. This condition during the time T51 to T52 is shown in FIG. 13.

In FIG. 13, during the time T51 to T52, the result of the decision in the step 101 in the subroutine A becomes YES and the operation moves to the step 102. In the step 102, the result of the decision becomes NO so that it gives no change to the value of OXR, but as in the correction subroutine C the relations XAF=1 and OXR≦0.45 V are maintained, and OXR is incremented in the step 155. As a result, OXR increases in the time between T51 and T 52. As long as no noise is injected in the value of OXR and no abnormal condition occurs, the above operation is repeated.

Figure 14:
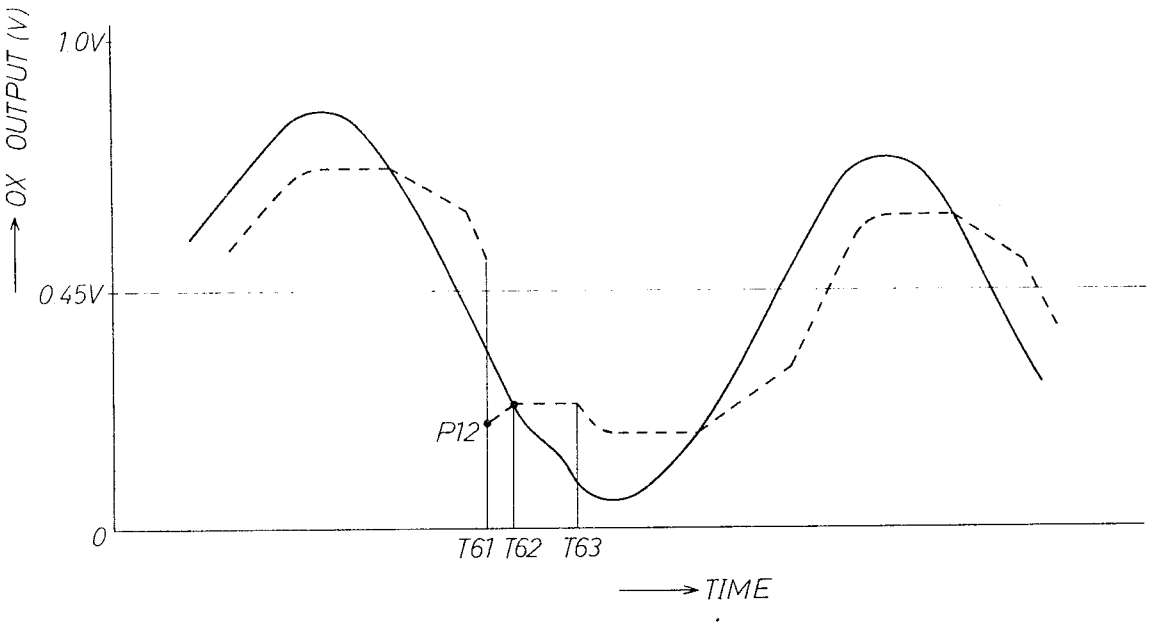

Next, supporsing that OXR changes so as to become below the value of OX, as shown in FIG. 14. Here, the value of OXR is shifted to the point P12 at the time T61 and it indicates that it became less than the value of OX.

Just before the time T61, as XAF is equal to 0 in the step 101 in the subroutine A in FIG. 7, the result of the decision becomes NO and the operation now moves to the step 104. In this step 104, as OX−OXR≦−0.2 is established, the result of the decision in this step becomes NO and the next step 105 is to be executed. In the step 105, as OX+0.2 is set for OXR and in the step 106, as OX<OXR is established, the result of the decision in this step becomes NO and the operation now moves to the step 108, where XAF is set to 0 and similar operation is repeated.

When the value of OXR at the point P12 lowers due to, for example, the noise when setting OXR in the step 105 at the time T61, the result of the next step 106 will become YES since OX is larger than OXR and the operation now moves to the next step 107, where 1 is set into XAF.

When the operation returns to the subroutine A, the result of the decision in the step 101 becomes YES, and the operation moves to the step 102. In this step 102, if OX−OXR≦0.12 is established, the result of the decision in this step becomes NO and the value of OXR in the subroutine A does not change at all. However, in the subroutine C, as XAF is equal to 1 at the time T 61 in the step 121, the result of the decision becomes YES and the operation now moves to the next step 154. In the step 154, as the relation is OXR≦0.45 V, the result of the decision becomes YES and the increment in OXR is started by the execution of the step 155. As a result, OXR increases from the point P12 as shown in the graph in FIG. 14. The increase in the value OXR continues until the time T 62 at which time it becomes parallel with the time axis.

Next, just after the time T62, since OX is smaller than OXR in the step 106, the result of the decision in this step becomes NO and the operation now moves to the next step 108, where XAF is set to 0. This enables the increment in OXR in the correction subroutine C to stop. On the other hand, in the subroutine A the result of the decision in the step 101 becomes NO while in the step 104 the decision becomes YES. As a result, the value of OXR does not change in the operations of both subroutines and it becomes parallel with the time axis as shown in the graph in FIG. 14.

Thereafter, at the time T63, the result of the decision in the step 104 of the subroutine A becomes NO as the relation OX−OXR≦−0.2 is established, and the next step 105 is to be executed. In the step 105, the value of OX+0.2 is set for OXR and it changes along OX. Afterward, OXR changes as shown in FIG. 13.

In this manner as described, by returning from the point P12 to XAF=0 from XAF=1 in an early stage (by the increment operation of OXR using the correction subroutine C), the degree of the lowering of the feedback control pattern about OX can be suppressed (i.e., kept small) as compared with the control according to the prior art.

Figure 15:
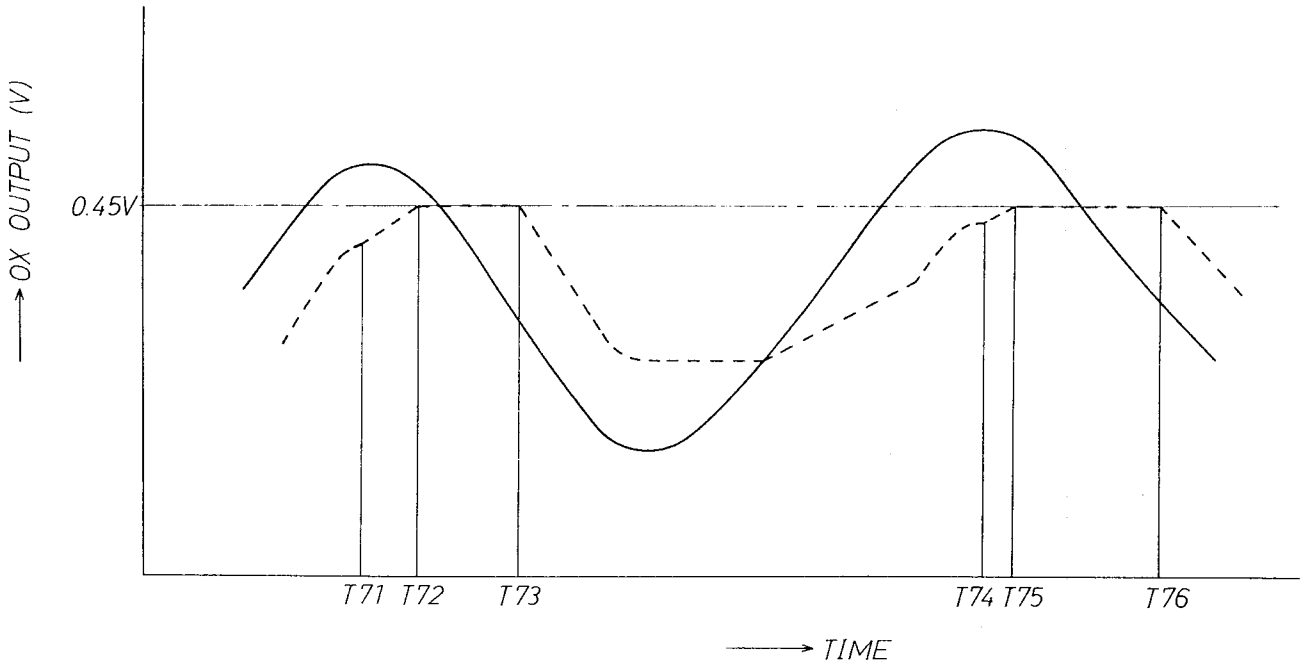

However, despite the above operation, when the levels of the above patterns successively lower due to the random noise and all of the values of OXR come below 0.45 V, the operation of this case is indicated in FIG. 15. Prior to the time T71, the result of the decision of the step 101 in the subroutine A become YES and the operation moves to the step 102. The result of the decision in the step 102 becomes YES and the operation now moves to the next step 103, where OX−0.12 is set for OXR in this step 103, and it tracks the trace along the movement of OX.

Since the relation OX−OXR≦0.12 is established in the step 102 of the subroutine A at the time T71, the result of the decision becomes NO in this step. As a result, the step 103 is no longer executed, and the value of OXR is maintained constant. Moreover, as OX is above OXR at this time, XAF is set to 1 in the step 107.

On the other hand, in the correction subroutine C, as the relations XAF=1 and OXR≦0.45 V are established, the step 155 is executed and the increment of OXR is started. As a result, OXR increases from the time T71.

Next, the result of the decision in the step 154 in the correction subroutine C at the time T72 (at which OXR becomes above 0.45 V) becomes NO due to the increase of OXR, and the increment operation of OXR is stopped. On the other hand, the result of the decision in the step 102 in the subroutine A is still maintained NO, the value of OXR does not change, (that is OXR is constant) and it stays parallel with the time axis in the graph.

When OXR crosses OX, the result of the decision in the step 101 in the subroutine A becomes NO as XAF=0, the operation now moves to the next step 104. In this step 104, the relation OX−OXR>−0.2 is still maintained, the result of the decision becomes YES so that there is no change in the value of OXR. On the other hand, in the beginning of the correction subroutine C, as the relations XAF=0 and OXR>0.45 V are established, OXR is decremented in the step 153, but it is slightly larger than 0.45 V. Accordingly, OXR becomes less than 0.45 V and the result of the decision in the step 152 becomes NO. As a result, the step 153 is no longer executed, and OXR becomes parallel with the time axis during the time between T73 and T74. Thereafter, at the time T73, as the relation OX−OXR≦−0.2 is established, the result of the decision in the step 104 in the subroutine A becomes NO and the operation now moves to the next step 105, where OX+0.2 is set for OXR. As a result, OXR changes along OX after the time T73.

Thereafter, unless the maximum value of OXR becomes above 0.45 V when no operation of the correction subroutine C is performed, OXR increases during the time T74 to T75, while in the time between T75 and T76 the value of OXR is maintained constant and the similar operation as described above is repeated.

In this manner, when the overall pattern of OXR becomes below 0.45 V, i.e., the maximum value of OXR becomes equal to or smaller than 0.45 V when no operation of the subroutine C is performed, an operation for lifting the maximum value above 0.45 V is performed. This enables XAF to be changed from 1 to 0 in an earlier stage, and the movement of OX is corrected towards a normal condition.

In summary, in the embodiments according to the present invention, even if the value of OXR lowers due to noise, for instance, in the first embodiment, the overall pattern of OX can be prevented from lowering in a small scale. Moreover, even if the overall pattern OX is going gradually lower because of noise, an the action for returning or restoring to normal is effected within a predetermined range.

In the foregoing embodiments, it has been described that only the increase in the OX pattern can be prevented in the first embodiment, while both the increase and decrease of the OX patterns can be prevented in the second embodiment according to the present invention. It is also possible to prevent only the decrease (or lowering) of the OX pattern in the embodiments according to the present invention. For instance, this can be realized by a modified subroutine C in which the steps 152 and 153 are omitted from the correction subroutine C of the second embodiment according to the present invention.

Accordingly, in the method according to the present invention, even if noise is produced in an electronic control unit, abnormal air/fuel ratio can be kept small, thereby preventing the degradation of proper emission and driveability.

In the present invention, it is also possible that even if the determined value abruptly becomes an abnormal value, it can be returned to a normal value at an early time, and a possible approach of the air/fuel ratio to an abnormal value (due to the gradual accumulation of abnromal derivation thereof) can be prevented within a predetermined allowable range.

While the present invention has been described in its preferred embodiments, it is to be understood that the words which have been used are words of description rather than limitation and that various changes and modifications may be made within the purview of the appended claims without departing from the true scope and spirit of the invention in its broader aspects.

What is claimed is:

1. A method of performing air fuel ratio feedback control for an internal combustion engine comprising the steps of:

(a) measuring the output value of an oxygen sensor, said output value representing oxygen concentration in exhaust gas of said engine;

(b) comparing said output value with a standard value, both with said standard value as added by a positive reference value and with said standard value as added by a negative reference value;

(c) determining, based on said comparing step, that the air/fuel ratio is rich when said output value is greater than said standard value and is lean when said output value is less than said standard value;

(d) updating, based on said comparing step, said standard value to be equal to said output value subtracted by said positive reference value only when said output value is greater than said standard value added by said positive reference value and to be equal to said output value subtracted by said negative reference value only when said output value is less than said standard value added by said negative reference value;

(e) comparing said standard value with a predetermined value;

(f) correcting, based on the first and second comparing steps, said standard value toward said predetermined value when said standard value is greater than said output value and is greater than said predetermined value, and when said standard value is less than said output value and is less than said predetermined value; and (g) controlling, based on said first comparing step, said engine air/fuel ratio toward optimum air/fuel ratio by decreasing an amount of fuel injection when the air/fuel ratio is determined to be rich, and by increasing the amount of fuel injection when the air/fuel ratio is determined to be lean.

2. A method according to claim 1 wherein said positive reference value is selected from the range of values corresponding to a voltage range between 0.08 V and 0.3 V, and said negative reference value is selected from a range of values corresponding to a voltage range between −0.1 V and −0.3 V.

3. A method according to claim 1 wherein said predetermined value is selected from values corresponding to a voltage range between 0.45 V and 0.55 V.

4. An apparatus for performing air/fuel ratio feedback control for an internal combustion engine comprising:

(a) an oxygen sensor for generating an output signal indicative of oxygen concentration in the exhaust gas of an exhaust manifold of said engine;

(b) first comparing means for comparing said output signal with a standard signal added respectively by both a positive reference signal and by a negative reference signal;

(c) determining means, responsive to said first comparing means, for generating a rich signal when said output signal is greater than said standard signal and for generating a lean signal when said output signal is less than said standard signal;

(d) updating means, responsive to said first comparing means, for updating said standard signal to be equal to said output signal subtracted by said positive reference signal only when said output signal is greater than said standard signal added by said positive reference signal and to be equal to said output signal subtracted by said negative reference signal only when said output signal is less than said standard signal added by said negative reference signal;

(e) second comparing means for comparing said standard signal with a predetermined signal;

(f) correction means, responsive to said first and second comparing means, for correcting said standard signal toward said predetermined signal when said standard signal is greater than said output signal and is greater than said predetermined signal, and when said standard signal is less than said output signal and is less than said predetermined signal; and (g) controlling means for controlling said engine air/fuel ratio toward optimum air/fuel ratio by decreasing ON duration of a fuel injecting signal indicative of fuel amount when the rich signal is generated, and by increasing ON duration of said injecting signal when the lean signal is generated.

5. An apparatus as in claim 4, wherein said positive reference signal is within a range of 0.08 volts to 0.03 volts, and said negative reference signal is within a range of −0.1 to −0.3 volts.

6. An apparatus in claim 4, wherein said predetermined signal is within a range of 0.45 volts to 0.55 volts.

* * * * *